US010941358B2

(12) United States Patent
De Araujo Monteiro et al.

(10) Patent No.: US 10,941,358 B2
(45) Date of Patent: Mar. 9, 2021

(54) REFINING PROCESS FOR HIGHLY (POLY)AROMATIC AND NITROGENATED CHARGES

(71) Applicant: PETROLEO BRASILEIRO S.A.—PETROBRAS, Rio de Janeiro (BR)

(72) Inventors: Carlos Alberto De Araujo Monteiro, Rio de Janeiro (BR); Donizeti Aurelio Silva Belato, Rio de Janeiro (BR); Jorge Roberto Duncan Lima, Rio de Janeiro (BR); Denise Barcellos Da Rocha Monteiro, Rio de Janeiro (BR); Jose Luiz Zotin, Rio de Janeiro (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 16/328,168

(22) PCT Filed: Jul. 19, 2017

(86) PCT No.: PCT/BR2017/000077
§ 371 (c)(1),
(2) Date: Feb. 25, 2019

(87) PCT Pub. No.: WO2018/014097
PCT Pub. Date: Jan. 25, 2018

(65) Prior Publication Data

US 2019/0225896 A1 Jul. 25, 2019

(30) Foreign Application Priority Data

Jul. 20, 2016 (BR) ..... 10 2016 016757-4

(51) Int. Cl.
*C10G 67/02* (2006.01)
*C10G 67/14* (2006.01)
*C10G 69/02* (2006.01)

(52) U.S. Cl.
CPC ..... *C10G 67/02* (2013.01); *C10G 67/14* (2013.01); *C10G 69/02* (2013.01); (Continued)

(58) Field of Classification Search
None
See application file for complete search history.

(56) References Cited

U.S. PATENT DOCUMENTS 4,738,766 A 4/1988 Fischer et al.
8,721,871 B1 5/2014 Dindi et al.
(Continued)

FOREIGN PATENT DOCUMENTS

BR PI 0610750 A2 11/2010
WO 2015/047971 A3 4/2015

OTHER PUBLICATIONS

International Search Report for PCT/BR2017/000077 dated Oct. 24, 2017.
Written Opinion for PCT/BR2017/000077 dated Oct. 24, 2017.

*Primary Examiner* — Tam M Nguyen
(74) *Attorney, Agent, or Firm* — Sughrue Mion, PLLC

(57) ABSTRACT

The present invention describes a method for refining highly polyaromatic and nitrogenated charges, such as LCO streams, comprising hydrotreating (HDT) as the first reaction stage, followed by the intermediate separation of gases generated in the HDT section, then by a second reaction stage consisting in moderate hydroconversion/hydrocracking and in a rectifying and/or fractionating section, thus allowing more flexible production of fuels. In the rectification mode, the claimed method yields a diesel oil fraction with higher cetane content, reduced density and volumetric (Continued)

LCO Charge:
Invention: d20/4 = 0.9477/ S = 6870 mg/kg/ N = 2530 mg/kg/ ICC = 25/NC = 12
Technological Reference 1: d20/4 = 0.9360 / S = 10,000 mg/kg / ICC = 28
Technological Reference 2: d20/4 = 0.9568 / S = 2000 – 15,000 mg/kg / N = 100-750 mg/kg / ICC = 22 yield increase of at least 111% relative to the process charge, thus minimising yield losses through naphtha overcracking and contributing to the optimisation of the required hydrogen consumption. In the fractionating mode, different cuts and their compositions can be produced, such as naphtha, kerosene and diesel.

20 Claims, 2 Drawing Sheets

(52) U.S. Cl.
CPC ..... *C10G 2300/1096* (2013.01); *C10G 2300/202* (2013.01); *C10G 2300/307* (2013.01); *C10G 2400/04* (2013.01); *C10G 2400/08* (2013.01)

(56) References Cited

U.S. PATENT DOCUMENTS

| | | | |
|---|---|---|---|
| 2003/0111387 | A1 | 6/2003 | Mukherjee et al. |
| 2006/0131212 | A1 | 6/2006 | Dahlberg et al. |
| 2008/0159928 | A1 | 7/2008 | Kokayeff et al. |
| 2009/0159493 | A1 | 6/2009 | Bhattacharya |
| 2011/0303585 | A1 | 12/2011 | Dath et al. |
| 2012/0043257 | A1 | 2/2012 | Dziabala et al. |
| 2014/0124409 | A1 | 5/2014 | Dindi et al. |
| 2015/0267130 | A1 | 9/2015 | Butley et al. |

LCO Charge:

Invention: d20/4 = 0.9477/ S = 6870 mg/kg/ N = 2530 mg/kg/ ICC = 25/NC = 12

Technological Reference 1: d20/4 = 0.9360 / S = 10,000 mg/kg / ICC = 28

Technological Reference 2: d20/4 = 0.9568 / S = 2000 – 15,000 mg/kg / N = 100-750 mg/kg / ICC = 22

REFINING PROCESS FOR HIGHLY (POLY)AROMATIC AND NITROGENATED CHARGES

CROSS REFERENCE TO RELATED APPLICATIONS

This application is a National Stage of International Application No. PCT/BR2017/000077 filed Jul. 19, 2017, claiming priority based on Brazilian Patent Application No. 10 2016 016757-4 filed Jul. 20, 2016.

FIELD OF THE INVENTION

This invention relates to a refining process for highly (poly)aromatic and nitrogenated charges, such as light oil recycling stream and its mixtures with other refinery streams, in two reaction stages (hydrotreatment, followed by intermediate separation of gases and hydroconversion/hydrocracking of the liquid fraction resulting from the intermediate gas separation) and containing rectification and/or fractionation section, allowing the flexibilization of fuel production. In rectification mode, the claimed process results in a fractionation of diesel oil with higher gain in cetane, reduction of density and elevation of the volumetric yield by at least 111% in relation to the process charge, thus minimizing losses in yield by overcracking naphtha and contributing to the optimization of the required hydrogen consumption. In fractionation mode, different cuts and their compounds can be produced, such as naphtha, kerosene and diesel.

BACKGROUND OF THE INVENTION

The domestic diesel market is characterized by a progressive increase in demand and increasingly restrictive quality specifications, either by gradual reductions in sulfur and aromatics, reduction in the density range and in the distillation curve, or by elevations at its flash point and cetane number.

For the charges with distillation range already adjusted as diesel oil, it is evident the need for investments in hydrotreatment units (HDT) with nominal capacity and high operational severity, that is, with higher volumes of catalyst and/or partial pressure of hydrogen, besides the reduction in the incorporation of unstable charges, especially those from the fluid catalytic cracking (FCC) process, such as the light cycle oil (LCO).

Although already adjusted to the distillation range of diesel oil, the LCO, which is efficient in the fluid catalytic cracking (FCC) process between 10 and 30% by mass, presents high levels of (poly)aromatic compounds and sulfur, as well as low cetane number (<19) and high density, the fuel oil diluent being commonly degraded or added in small proportions to the HDT units charges of medium distillates for the production of diesel oil, the latter option at the expense of greater operational severity and consumption of hydrogen. In addition, even though it is compatible with its distillation range via fractionation, LCO presents a much lower quality for incorporation into the aviation kerosene pool (intense color, high nitrogen content, high soot, high density and high aromatic content).

The strategy of incorporating LCO into the charges of hydrotreatment units is limited, since it demands elevations in operational severity and in the consumption of hydrogen, contributing to the reduction of the time of campaign of the industrial unit and increase of the operational cost. Future developments of this stream in the diesel oil pool will no longer be permitted as the specifications of this derivative become increasingly more restrictive. On the other hand, its addition as fuel oil diluent is an increasingly devalued option in the scenario of a marked decrease in the demand for such derivative, characterized by low value added. Alternatively, the use of LCO as a diluent for bunker production will be restricted in the future due to the trend of reduction of sulfur content in marine fuels.

In Table 1 are exemplified the main characteristics of LCO streams obtained from fluid catalytic cracking of gas oils from heavier and aromatic-naphthenic oils (LCO A, B and C) compared to those obtained from oil cast light and less aromatic-naphthenic (LCO D), evidencing the quality leap necessary to its framing and incorporation into the diesel oil pool.

TABLE 1

Characteristics of Typical LCO Streams obtained from fluid catalytic cracking of gas oils from heavier and naphthenic oils (LCO A, B and C) compared to those obtained from cast with lighter and less aromatic oil (LCO D).

| Properties | LCO A | LCO B | LCO C | LCO D |
|---|---|---|---|---|
| Density @ 20/4° C. (ASTM D4052) | 0.9522 | 0.9477 | 0.9720 | 0.9205 |
| Atmospheric Distillation (ASTM TD86) | | | | |
| Temperature of 10% vaporized vol., ° C. | 250 | 249 | 295 | 220 |
| Temperature of 50% vaporized vol., ° C. | 270 | 288 | 318 | — |
| Temperature of 95% vaporized vol., ° C. | 321 | 368 | 365 | 358 |
| Sulfur content (ASTM D5453), mg/kg | 6763 | 6870 | 6407 | 9285 |
| Nitrogen content (ASTM D5762), mg/kg | 1910 | 2530 | 3258 | 884 |
| Total Aromatics per SFC (ASTM D5186), % w/w | 82 | 72 | 74 | 63 |
| PAHs (2+ rings) per SFC (ASTM D5186), % w/w | 67 | 53 | 63 | 36 |
| Cetane Number (ASTM D613) | <18 | <18 | <18 | 24 |

Since the LCO's ASTM D-86 distillation curve is already specified for diesel oil, in order to respond to the increased demand of this fuel and to promote value addition to the LCO stream, reductions in sulfur and (poly)aromatic contents are required, as well as in the density and, also, increase in the number of cetane, minimizing the losses of yield. Unless the sulfur content is reduced, the quality improvement (LCO A, B and C) is more challenging for streams derived from heavier and more aromatic-naphthenic (LCO A, B and C) oils than those listed in Table 1 (density, nitrogen, aromatic and (poly)aromatic and cetane numbers).

Additionally, as a strategy to minimize the importation of diesel oil to serve the Brazilian domestic market, the FCC units could be adjusted to operate in LCO maximization mode, increasing the volume of unstable stream demanding intensive treatment for its incorporation into the diesel oil pool.

In a highly globalized world market scenario need to increase the profitability of the supply/refining business, it becomes evident the importance of developing technologies for quality improvement of LCO.

In general, most refineries in the United States and Europe, countries with significant demand for heating/calefaction sources, hydrotreat the LCO charge to reduce sulfur content, and then compose the heating oil pool. Only a small fraction, up to 30% by mass of the total charge, is previously hydrotreated along with other petroleum fractions (direct distillation, vacuum and delayed coking gas oils) to form the diesel oil pool.

Among the licensed hydrorefining technologies most used for LCO valorization, we highlight the single-stage hydrotreatment, hydrotreatment in two stages (deep aromatic saturation, hydroisomerization and/or selective opening of naphthenic) or hydrotreatment followed by moderate hydrocracking (MHC—Mild Hydrocracking) or severe (HCC—Hydrocracking). In relation to the processed charge, one of the options is the pure LCO or mixed with gas oils (atmospheric, vacuum and delayed coking) and deasphalting oil.

Some licensors commercialize technological options for improving LCO via hydrotreatment route. The majority of them emphasize schemes in two reaction stages, where they perform deep aromatic saturation (HDA) and in some cases also the activity of naphthenic opening, responsible for greater gains in density and cetane, without significant loss in diesel yield. Some process schemes involve only deep hydrodesulfurization (HDS) and hydrodenitrogenation (HDN) reactions to reduce pollutants in the heating oil pool, with some aromatic saturation.

In document US2011/0303585 A1 a process is claimed and catalysts for deep hydrogenation of LCO, with high sulfur content, nitrogen and aromatics. The charge is hydrotreated in a first stage to removal of sulfur and nitrogen, possibly with aromatic compounds being hydrogenated (HDA), with conventional hydrotreatment catalyst (metals of group VI B and VIII supported on alumina and active in the sulfide form). The resulting effluent from this stage, optionally being removal of the formed $H_2S$ and $NH_3$, is sent to a second section of reaction with the objective of promoting deep hydrogenation of aromatics (HDA) in a catalyst consisting of a combination of platinum and palladium supported on silica-alumina dispersed in alumina binder, active in the form reduced. While this process is responsible for reduction of density and increase of cetane in relation to the charge, presents technical limitations, since the presence of organic sulfur and organic nitrogen in the effluent from the first section can poison the metallic components and acid support of the catalyst of the second section, respectively. In this sense, among the claims and requirements of this document, the effluent from the first reaction stage shall contain a nitrogen content of less than or equal to 5 mg/kg, in particular less than 2 mg/kg and more particularly less than 1 mg/kg. As regards the sulfur content at the exit of the first reaction section should be less than 5 mg/kg, in particular less than 2 mg/kg and more particularly less than 1 mg/kg.

In addition to or alternatively to the use of hydrotreatment processes, high pressure hydrocracking units have been historically employed in the cracking of LCO in mixtures with gas oils (direct distillation, vacuum and delayed coking) and/or oil decanted, obtaining naphtha and medium distillates of excellent quality.

High conversion hydrocracking units are relatively capital intensive, consume large amounts of hydrogen and naphtha, of excellent quality for petrochemical production, requires improvement through catalytic reforming before composing the gasoline pool.

In order to process 100% LCO charges, some technologies stand out by the partial conversion in highly selective catalysts, responsible for the cracking/opening of aromatics with 2+ rings, maintaining the monoaromatic in the naphtha range (high octane) and saturating and raising the content of paraffin in the diesel range (excellent cetane number). These processes are characterized by great operational flexibility in obtaining a certain diesel/naphtha ratio.

In this line, the U.S. Pat. No. 4,738,766A [35] stands out, which extends for the conversion of LCO and its different cuts, as well as for Heavy Recycling Oil of the FCC (HCO or heavy cycle oil). This patent claims a process in which the conversion into a product in the gasoline distillation stage is in the range of 10 to 65% by volume, that is, no claim is made for a process that increases the volumetric efficiency of the fractionation in the diesel oil range.

Most of the patented processes and catalysts for hydroconversion of LCO have the objective of producing a fractionation of naphtha with high benzene, toluene and xylene (BTX) composition, i.e., assuming the loss of selectivity to the average distillates, as in the case exemplified by the patent US 2013/0210611 A1.

In patent US2012/0043257 A1 [34], a process is claimed which employs a combination of hydrotreatment in moderate severity followed by hydrocracking of highly aromatic streams such as LCO for the diesel production with low sulfur content and naphtha with high octane. The patented concept is because the presence of a minimum content of organic nitrogen compounds (from 20 to 100 mg/kg) in the effluent generated in the LCO hydrotreating section is responsible for the reduction of the hydrogenation activity of the monoaromatic compounds in the hydrocracking section, resulting in a naphtha with high octane. To produce diesel oil with low sulfur, it is desirable to further treat the hydrocracking section effluent by employing an additional bed of hydrotreating catalyst. This patent claims a process whose naphtha yield is in the range of 30 to 65% by mass of the hydrocracking effluent. The other cut produced consists of product in the range of diesel oil, however with properties that do not meet the diesel oil stream specifications.

In this regard, BISHT, D., PETRI, J., "Considerations for Upgrading Light Cycle Oil with Hydroprocessing Technologies" (Indian Chemical Engineer, Volume 56, Issue 4, 2014, pp. 321-335. DOI: 10.1080/00194506.2014.927179) document relates to various ways of economically improving LCO streams by processes including HDT, high temperature hydrocracking for complete conversion of the LCO to naphtha and an optimized partial conversion hydrocracking process which would be flexible and effective for processing LCO in products, such as diesel with very low sulfur contents and naphtha with high octane and aromatics. However, the example presented in this document illustrates a one-stage process scheme without intermediate gas separation and applied to a filler characterized by having a low organic nitrogen content. Low levels of organic nitrogen in the charge favors choice by the process without intermediate gas separation and in one stage. Also in this document, the production of high octane rating naphtha is cited as an objective, which necessarily means a yield loss in the production of diesel oil through the quality-improving process of LCO.

On the other hand, the U.S. Pat. No. 8,721,871 B1 document discloses a hydroprocessing process of a low value LCO hydrocarbon stream to provide a product in the high value-added diesel range. Its process deals with LCO streams containing highly (poly)aromatic and sulfur contents, as well as low cetane number (<30) and high density, however, there is a loss of diesel oil by overcracking naphtha.

WO2015/047971 relates to a process of hydroprocessing of a hydrocarbon stream of gas oil, which contains high levels of sulfur, nitrogen and aromatics (particularly (poly) aromatic), as well as high density and low cetane number.

This process aims to provide a product with high yield in the diesel range, however, yield losses in diesel by naphtha.

In this way, it is possible to observe that there are no reports in the state of technique that reveal streams benefit processes for the highly ((poly)aromatic) and nitrogenous that allow flexibilization of the production of fuels (maximizing the production of kerosene and diesel oil), without excessive hydrogen consumption and naphtha overcracking losses.

SUMMARY OF THE INVENTION

This invention relates to a refining process of highly (poly)aromatic and nitrogenated charges, such as LCO streams, under conditions in which medium distillates are produced (oil diesel/kerosene) with low levels of nitrogen and sulfur.

A first aim of this invention is to improve the quality of a LCO stream, with use and appreciation of this stream, via reduction of its density and increase of the cetane in a process in two reaction stages, thus generating a higher volumetric efficiency of fractionation in the distillation range in a process with lower fuel consumption of hydrogen.

A second aim of this invention is to favor the selectivity to medium distillates (kerosene and diesel oil), giving greater gain in cetane, reduction of density and elevation of the volumetric fractional yield in the diesel oil distillation range, thus minimizing the losses in naphtha overcracking.

In order to achieve the objectives described above, this invention tries to carry out a process in two reaction stages where, in contact with hydrogen partial pressure, the charge is hydrotreated (HDT) in the first stage using a catalyst with predominance of hydrogenating function for the preferential reduction of nitrogen content organic. After the intermediate separation of gases generated in the HDT section (such as ammonia, hydrogen sulfide and volatile hydrocarbons), the effluent is directed for the second stage, hydroconversion/moderate hydrocracking, cetane gain, reduction of density and volumetric efficiency of fractionation in the diesel oil distillation range, thus minimizing naphtha overflow losses. The separation of gases favors selectivity to medium distillates (diesel oil and kerosene) in the second stage and the process, in general, provides better quality diesel oil in a process with lower hydrogen consumption.

This invention is capable of processing LCO- and mixtures thereof with direct (atmospheric and vacuum) distillation charges and delayed coking and streams of a renewable nature (pyrolysis bio-oil, thermal cracking, etc.)—which are highly aromatic and (poly)aromatic, and also with high nitrogen contents.

The inventors propose an alternative process in which the removal of nitrogen in the first stage generates a liquid effluent with higher nitrogen contents than those of the prior state of the art HDT processes, thus requiring less severity of the first stage and a lower investment. This, together with the intermediate separation for H2S and NH3, provides an adequate control of the selectivity of the reaction in the second stage, favoring higher yields of medium distillates (kerosene and diesel) and low naphtha formation.

These aims and other advantages of this invention will become more evident from the following description and the accompanying drawings.

BRIEF DESCRIPTION OF THE FIGURES

A detailed description presented below refers to the attached figures, where.

DETAILED DESCRIPTION OF THE INVENTION

Figure 1:
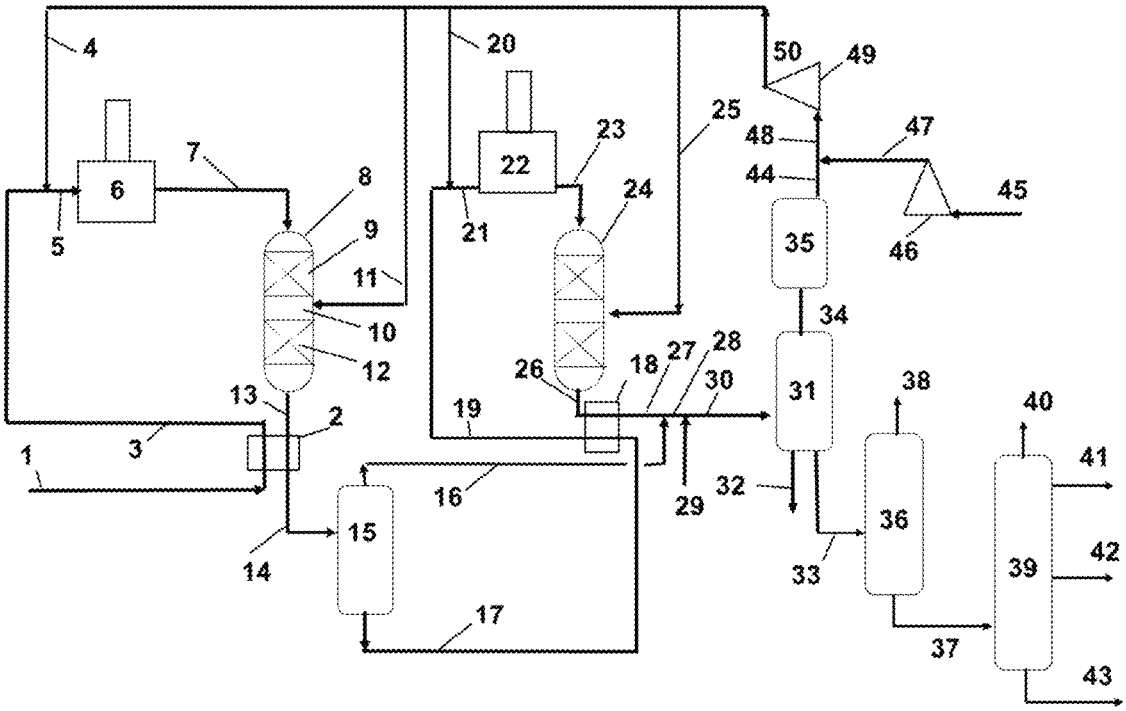
FIG. 1 represents a proposed configuration for the process according to this invention.

This invention relates to a refining process for highly (poly)aromatic and nitrogenated charges, such as LCO obtained in Fluid Catalytic Cracking (FCC) units, in two reaction stages and which comprises intermediate gas separation. The intermediate gas separation, mainly consisting of ammonia and generated in the HDT section, favors the selectivity of middle distillates (diesel oil and kerosene) in the second hydroconversion/hydrocracking stage. If the second stage of reaction were conducted in the presence of ammonia, a high operational severity (preferably via an increase in the bed temperature of the hydroconversion catalyst) to compensate for the neutralization of the acid analysis of the hydroconversion/hydrocracking catalyst by ammonia, thus reducing the selectivity of medium distillates (kerosene and diesel).

In the context of this invention, any highly aromatic charge (total aromatic contents: from 20 to 90% w/w, preferably 30 to 80% w/w and more preferably 50 to 70% w/w) and (poly)aromatic (total (poly)aromatic contents: from 10 to 80% w/w, preferably from 15 to 75% w/w, more preferably from 20 to 70% w/w) and with a high content of nitrogen compounds (0 to 5000 mg/kg, preferably 300 to 4000 mg/kg and more preferably 500 to 3000 mg/kg). Stream means preferably pure recycle oil (LCO) and mixtures thereof with chains direct (atmospheric and vacuum) distillation and delayed coking and renewable nature (bio-oil pyrolysis, thermal cracking, etc.). The charge and its components have an ASTM D-86 distillation range of 100 to 420° C., preferably from 120 to 400° C. and more preferably from 140 to 380° C. The charge processing with pure LCO can represent an internal solution and value added to the refinery, insofar as it allows for greater flexibility of existing HDT plants (LCO can reduce the severity, allowing the processing of larger volumes of direct distillation and delayed coking HDT already existing in the refining park). This invention is the only one claims a process for the production of medium distillates (kerosene and diesel) of superior quality from the conversion of a as high aromatic properties (total aromatics up to 90% w/w and (poly) aromatic up to 80% w/w), high relative density (density 20/4° C. of 0.9 up to 1.0) and very low cetane number (<18), unique characteristics associated to the LCO generated from the list of Brazilian oils.

By organic nitrogen content is meant the nitrogen content determined by the ASTM D5762 method (mg/kg or ppm units). Per content of aromatic and (poly)aromatic means the total aromatics and (poly)aromatic contents (with two or more aromatic rings) determined by Supercritical chromatography by ASTM method D5186-03 or equivalent. By cetane number is meant the determination of the ignition power by the method ASTM D-613. Relative density refers to the ratio of the specific mass of the fluid of interest measured at 20° C. and the specific mass of the water at 4° C. ASTM D4052).

By hydrotreating section (HDT) it is understood the one responsible, preferably, for the hydrogenation reactions of olefins, hydrodesulfurization (HDS), hydrodenitrogenation (HDN) and hydrodearomatization (HDA), and may also involve hydrodemetallization (HDM) reactions, hydrodeoxygenation (HDO) and some conversion (HCC and MHC). This section may be constituted by one or a series of reactors with one or more beds of HDT catalysts. It may also include guard beds for the removal of impurities, poisons from catalysts, particulates and organometallic compounds present in the charge. Because they are highly exothermic reactions, bed effluents catalysts can be cooled by quenches of recycle gas or liquid products obtained in the process itself. Reactor internals include gas and liquid distributors, trays, quench dispensers, among other devices to support the beds and promote improvement in heat and mass transfer. The catalysts of the hydrotreating section include materials consisting of hydrogenating phases in the oxidized form (e.g. Group VIII (IUPAC) and/or Group VI (IUPAC) elements and mixtures of both) supported on an inert matrix and/or with some acid-base activity (alumina, silica-alumina, zeolite, silica, titania, zirconia, magnesia, clay, hydrotalcite, among others) and/or with additives promoting acid functions or specific nature, such as boron and phosphorus compounds. The catalyst has activity in the sulfide form. Operating conditions of the hydrotreating zone include partial pressure of $H_2$ from 1 to 200 bar, preferably 40 to 150 bar, more preferably 50 to 120 bar; temperature between 200 and 450° C., preferably between 320 and 430° C., preferably between 340-410° C. and volumetric space velocity (liquid hourly space velocity—LHSV—ratio between volumetric load flow and volume of catalyst) from 0.1 to 5 $h^{-1}$, preferably from 0.2 to 3.0 $h^{-1}$, more preferably between 0.3 to 2.0 $h^{-1}$. This section is responsible for mainly due to the adjustment of the organic nitrogen content of the effluent to the hydroconversion section (exemplified by reactor 24). If the nitrogen in the range of 0.5 to 500 mg/kg, preferably 1 to 400 mg/kg and more preferably from 10 to 300 mg/kg. This invention provides best performance when the hydrogenated effluent generated in the HDT section has a high nitrogen content, more preferably from 100 to 300 mg/kg.

Several patents associate the best performance of the hydroconversion to a severe reduction in the nitrogen content of the cargo, preferably in the range below 20 mg/kg, thus avoiding a greater deactivation of the hydroconversion section's catalytic system. In this maintenance of high organic nitrogen content (more preferably from 100 to 300 mg/kg) in the effluent generated in the first section of HDT, acts as a way to control the selectivity of the hydroconversion section, avoiding overfilling to the naphtha and guaranteeing high volumetric expansion in relation to diesel oil.

In addition, the presence of higher nitrogenous contents in the effluent from the hydrotreating section, when compared to those reported by state of the art, ensures the achievement of important yields of high-quality aviation kerosene.

The second section constituting the process of this invention is represented by the hydroconversion section, mainly responsible for the reduction of density, increase of cetane and high volumetric expansion of the fractionation in the diesel range. It also involves hydrodearomatization and naphthenic ring opening reactions. This section may consist of a series of reactors with one or more beds of HCC/MHC catalysts. They may also include guard beds for removal of impurities, poisons from particulate and organometallic catalysts present in the filler. Because they are highly exothermic reactions, the effluents from the catalytic beds can be cooled by quenches of recycle gas or hydrogenated liquid product obtained in the process itself. Reactor internals include gas and liquid distributors, trays, quench dispensers, among other bed support devices and for the promotion of heat and mass transfer enhancements. Per catalysts of the hydroconversion/moderate hydrocracking section, are including hydrogenated phase materials in the oxidized form (at least one Group VII [IUPAC] and Group VI (IUPAC) elements and mixtures of both supported on inert matrix and/or with some acidic activity (alumina, silica-alumina, zeolite, silica, titania, zirconia among others) and/or with acidic function enhancing additives or specific nature such as boron and phosphorus compounds. The catalysts are activated by sulfation or reduction. If active catalysts are used in the sulfide phase, it is necessary to admit gas charge with $H_2S$ to maintain these sulfides. Operating conditions of the hydrocracking section include partial pressure of $H_2$ from 1 to 200 bar, preferably from 40 to 150 bar, more preferably from 50 to 120 bar; temperature between 200 and 450° C., preferably between 320 and 430° C., more preferably between 340 and 410° C. and LHSV between 0.1 and 5 $h^{-1}$, preferably between 0.2 and 3.0 $h^{-1}$, more preferably between 0.3 a 2.0 $h^{-1}$.

Both reaction sections preferably operate with fixed bed catalysts and guard beds, under trickle bed regime, with charge and flowing concurrently. However, the invention may operate with reactors operating under charge-flow hydrogen, as well as combined co- and countercurrent regimen.

In FIG. 1, one of the variants of the process scheme proposed for this invention. In this process, the charge 1, after being heated in the preheating battery of heat exchangers between the charge and the product of the first stage 2, mixed with a recycle hydrogen stream 4 and heated in a furnace of the first stage 6, is admitted to the first stage reactor 8. Mixing the charge with the recycle hydrogen may occur before or after of the preheating battery 2 or in the region between the same preheating battery 2. The first stage reactor 8 may be constituted by one or a series of reactors containing one or more beds of catalysts 9, 12 in each pressure vessel. Between each pair of catalyst beds there is a region 10 for the admission of a quench charge, which in one of the possibilities can be constituted by the recycle hydrogen stream 11. Another possibility of stream to quench the beds can be constituted by a hydrogenated product charge from the first or second process stage (alternative not indicated in FIG. 1 of the invention). The vessels the reactors are equipped with of liquid and gas and apparatus responsible for fixing the catalyst beds and bed of guard. The effluent 13 of the last first stage reactor exchanges heat with the first stage charge in the heat exchanger preheating battery between charge and the product of the first stage 2, resulting in a biphasic vapor liquid stream 14 which is directed to a high pressure and high temperature separator vessel 15. This vessel is responsible for the separation of a gaseous charge rich in hydrogen, ammonia and hydrogen sulfide, also containing hydrocarbons 16, and of a liquid charge containing hydrocarbons 17. Another possibility for the operation of the separator vessel 15 is the injection of gaseous charge recycling of the process, replacement hydrogen, for example) to favor the removal of $H_2S$ and $N_H3$ from the liquid hydrocarbon, allowing reactor of the second stage with catalysts based on platinum type noble metals, palladium, rhodium, iridium, pure or mixed, supported on an inert matrix and/or some acidic activity (alumina, silica-alumina, zeolite, silica, titania, zirconia, magnesia, clay, hydrotalcite, among others). The liquid charge 17 is then heated in a preheating battery of heat exchangers between the second stage effluent 18, mixed with a recycle hydrogen stream 20, heated again in the second stage charge furnace 22, being subsequently admitted to the second stage reactor 24. The charge mixture heated with the recycle hydrogen may occur before or after the battery of preheating 18 or in the region between the series heat exchangers of the same battery. The second stage reactor 24 may be constituted by one or a series of reactors with one or more fixed beds of catalysts in each pressure vessel. Between each pair of catalyst beds there is a region for the admission of a charge of quench, which in one of the possibilities can be constituted by the recycle hydrogen stream 25. Another possibility of stream to quench the beds can be constituted by a hydrogenated product charge from the first or second stage of the process (alternative not indicated in the Figure of the invention). The reactors are equipped with liquid and gas and apparatus responsible for fixing the catalyst beds and bed of guard. The effluent 26 of the last second stage reactor exchanges heat with the second stage charge on the heat exchanger preheating battery between charge and effluent of the second stage 18, resulting in a biphasic liquid-vapor mixture stream 27 which is mixed with the top gas stream 16 of the high pressure and high temperature separator vessel 15. The resulting final charge 28 can be cooled (not shown in FIG. 1) and usually receives the injection of wash water 29 to prevent the inlay of ammonium salts and sulfide, among other salts, in sections subjected to temperatures below 150-160° C. The resulting charge of this blend 30 is then sent to a high pressure and low temperature 31, responsible for the separation of three phases: gaseous 34, aqueous 32 and oily water. The aqueous phase 32 is destined for the treatment of acid waters. The oil phase 33 is directed to the rectification section 36 and fractionation 39. The gas phase 34, rich in hydrogen, may or may not be purified in section 35, which may be composed of amine at high pressure, including the regeneration of the aqueous rich amine solution in $H_2S$. The $H_2S$ poor gas stream 44 is compressed in a compressor of recycle 49, generating the hydrogen recycle streams and quenches from the catalytic beds. The hydrogen consumed in the process, whether by chemical consumption, by the losses and dissolution of hydrogen in the oil) is reset (stream 45) after compression in the replacement compressor 46, the inlet point hydrogen (chain 47) is located in the suction or uncharge of the recycle compressor (equipment 49). In one embodiment of the invention, the process can only operate in rectification mode 36, generating a stream containing light hydrocarbons, hydrogen and $H_2S$ 38 and a stream of hydrocarbons 37 which may be added to the pool of diesel oil from the refinery. In another possibility, the chain 37 may be fractionated in gas 40, naphtha 41, kerosene 42 and diesel oil 43. The stream 41 can compose the gas pool of the refinery or be processed in another process (catalytic reform for gasoline production, steam reform for the generation of hydrogen, etc.). The stream 42 may comprise the aviation kerosene pool of the refinery. The stream 43 may comprise the refinery's diesel oil pool. The pool of diesel oil from the refinery can also receive the streams 41, 42 and 43 or only the streams 42 and 43.

The liquid effluent 33 from the vessel 31 can only be rectified or separated into fractions of different distillation ranges (naphtha, kerosene and diesel) in a fractionator tower. By naphtha is meant the cut in the distillation range typical of $C_5$ to 150° C., preferably, being able to present alternatively other initial boiling points in the range of 120 and 140° C., for example. By kerosene is meant the cut in the distillation range of 150 to 240° C., preferably, being able to alternatively display initial boiling points between 120 and 140° C. and final boiling points between 230 and 260° C. By diesel it is understood the cuts in distillation range of 240° C. up to final boiling point of the second stage section effluent, starting point to contemplate other temperatures between 230 and 260° C. The diesel fraction can also match the composition of kerosene and diesel fractions, previously reported.

The scheme shown in FIG. 1 is characterized by the use of the cold separation. Another possible variant of scheme for the claimed process is that of hot separation. In this, the effluent from the reaction stage (26) exchanges heat in the preheating battery (18), followed by a high pressure, high temperature separating vessel, which divides this stream into two others: a gaseous and a liquid. This chain with the gas stream 16 and with an injection charge of and proceed to a low temperature and high pressure. The liquid charge flows to the grinder (36). The separation vessel high pressure and low temperature generates three charges: an aqueous, which follows for the acid treatment section; a gaseous charge, which goes to the purification section (35) and gas compression/recycle; and a liquid charge which goes to the rectification machine (36).

The following description will depart from preferred embodiments of this invention. As will be apparent to one skilled in the art, the invention is not limited to these particular embodiments.

Examples

To illustrate the higher efficiency of the process described herein, conducted in one or two stages, with LCO streams following characteristics: density @ 20/4° C.=0.9477, sulfur content=6870 mg/kg, nitrogen content=2530 mg/kg, cetane index=25, and number of cetane=12.

Figure 2:
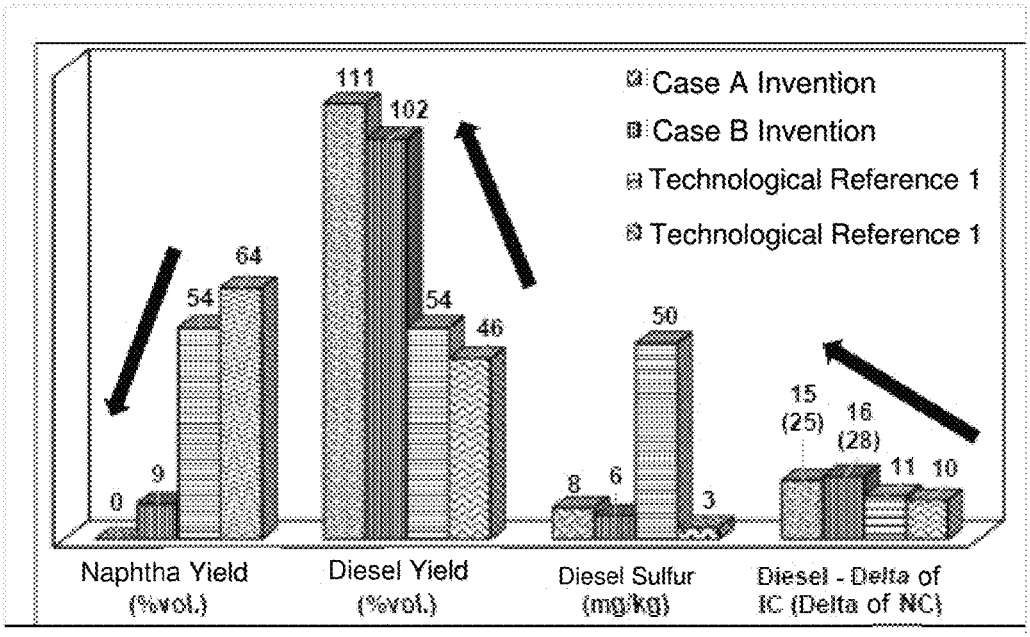
FIG. 2 represents a comparison as highlighted in the Example 1 of this invention.

The example 1 of this invention is illustrated by FIG. 2, which highlights the main advantages and differentials of the innovation claimed in comparison with technologies marketed by the main licensors' countries. In FIG. 2, the information associated with the caption "Reference Technological 1" are based on the document presented at the ERTC in 2004 (V. P. Thakkar, V. A. Gembicki, D. Kocher-Cowan, S. Simpson, "LCO Unicracking Technology—A Novel Approach for Greater Value Added and Improved Returns," ERTC, 2004, Vienna, Austria) and information contained in US2012/0043257 A1. Information associated with the caption "Technological Reference 2" refer to the document presented in the XIV Refinery Technology Meeting® in 2007 (W. Novak and co-workers "LCO Hydrocracking at Moderate Pressure" XIV Refinery Technology Meeting®, 2007) and information contained in U.S. Pat. No. 4,738,766A.

As can be seen in FIG. 2, it is to be noted that the invention is characterized by superior performance, even starting from a more refractory charge, with a high density, nitrogen and aromaticity characteristics of petroleum fractions obtained from the list of heavier and naphthenic oils, when compared to with light Arabic oil, for example. All technologies listed in FIG. 2 use the LCO hydroconversion strategy, however, the invention claimed is responsible for the largest number/cetane index gains and density and also contributes to a significant increase in volumetric yield in the distillation range of diesel oil and kerosene. In this same example, only two possibilities of operation of this invention: exclusive production of diesel oil in the tower bottom charge rectifier, apparatus 36 of FIG. 1, (Invention—Case A) or fractionation (in the fractionator tower 39 of FIG. 1) of the effluent from the rectification tower (equipment 36 of FIG. 1) with simultaneous production of naphtha and diesel oil (Invention—Case B). In both cases of operation, products are generated in the range of diesel oil with higher quality gains than licensors.

Example 2 of this invention is based on the comparison presented in Table 2, where two processes are compared for the improvement of LCO quality. The so-called "single stage" process represents the alternative of high severity HDT with conventional catalyst (mixed alumina-supported NiMo sulfides) for aromatic saturation. O "two-stage" process is one of invention herein. Note that for the same consumption of hydrogen (about 350-356 NI $H_2$/l charge), the two-stage process, as here claimed, gave higher density and cetane number variations for the final hydrogenated effluent obtained. This result can be optimization of the use of $H_2$ for the aromatic hydrogenation reactions and hydroconversion, which lead to the elevation of paraffin content in the final product, the content of paraffinic carbons, as well as mass.

TABLE 2

| Single-stage HDA X hydroconversion in two stages (this invention) | | | | | | |
|---|---|---|---|---|---|---|
| | | Freight | Single | Invention - Two Stage(*4) | | |
| Operational Condition | | 100% LCO | Stage | 1st Stage | 2nd Stage | Global |
| $PpH_2$ reactor output(*1) kgf/cm$^2$ a | | — | 131 | 93 | 81 | — |
| WABT(*2) | ° C. | — | 377 | 343 | 390 | — |
| LHSV(*3) | $h^{-1}$ | — | 1.0 | 1.5 | 1.0 | 0.6 |
| Density 20/4° C. | | 0.9477 | 0.8799 | 0.9102 | 0.8527 | 0.8527 |
| Delta of D 20/4° C. | | — | 0.068 | 0.038 | 0.095 | 0.095 |
| T10 ASTM D-86 | ° C. | 249 | 229 | 238 | 191 | 191 |
| T50 ASTM D-86 | ° C. | 288 | 265 | 274 | 247 | 247 |
| T90 ASTM D-86 | ° C. | 352 | 324 | 335 | 311 | 311 |
| Sulfur | mg/kg | 6870 | 4.5 | 161/2330(*6) | 8 | 8 |
| Aromatics SFC | % mass | 71.7 | 28.0 | 62.0 | 25.1 | 25.1 |
| % HDA SFC | % mass | — | 60.9 | 13.5 | 65.0 | 65.0 |
| Carom. ndM | % mol | — | 17.1 | 30.6 | 12.3 | 12.3 |
| Cnaft. ndM | % mol | — | 49.5 | 34.5 | 45.7 | 45.7 |
| Cparaf. ndM | % mol | — | 33.4 | 34.9 | 42.0 | 42.0 |
| Paraffins(*5) | % mass | 5.0 | 10.2 | 9.9 | 14.1 | 14.1 |
| Naphthenic(*5) | % mass | 12.4 | 62.0 | 22.4 | 59.7 | 59.7 |
| Aromatics(*5) | % mass | 82.7 | 27.8 | 67.7 | 26.2 | 26.2 |
| Cetane Number | | 12.0 | 34.6 | 23.7 | 37.0 | 37.0 |
| Delta NC | | — | 22.6 | 11.7 | 25.0 | 25.0 |
| ICC ASTM D-4737 | | 24.9 | 36.8 | 31 | 39.6 | 39.6 |
| Delta ICC | | — | 11.9 | 6.1 | 14.7 | 14.7 |
| Consumption of H2 NL/L | | — | 350 | 236 | 120 | 356 |

(*1)Hydrogen partial pressure in the last reactor
(*2)Mean Temperature of the Catalytic Bed
(*3)Volumetric Space Velocity
(*4)Claimed invention
(*5)Mass spectrometry
(*6)After doping to maintain the catalyst of the Second Sulfide Stage Example 3 of this invention is based on the comparison presented in Table 3, which shows the performance differential of the claimed invention when compared to conventional treatment of distillates, for example hydrotreating with catalysts conventional NiMo mixed sulfide type supported on alumina and HDT in two stages for high aromatic saturation (first stage with conventional HDT catalyst and second stage with metal catalyst noble Pt—Pd supported on silica-alumina). The invention results in greater gains of quality (lower density and higher cetane number), using a process conducted at lower pressure and similar hydrogen consumption when compared to the single stage HDT alternative with catalyst ("Severe HDT NiMo" column of Table 3). In addition, the invention results in a cut in the range of diesel oil of similar quality (density and cetane) to that obtained in the two-stage HDT process (column "HDT 1st Est. NiMo+2nd Est. PtPd" in Table 3), however consuming 26% less commonly available fuel, accounting for 70 to 80% of the operating units of hydrorefining units. This invention contributes to expressive improvement in stream quality that would normally be degraded in fuel oil, even while consuming less hydrogen, which ensures reduction of operational costs for the refinery. No status documents of the technique suggest a process for improving LCO stream by highlighting this benefit.

TABLE 3

Advantages of this invention and its comparison with conventional hydrorefining processes.

| Product Quality in the Diesel Oil Range | Charge LCO | Diesel Cutting generated in the Invention | HDT 1st Est. NiMo + 2nd Est. PtPd | HDT Severe NiMo |
|---|---|---|---|---|
| Distillation Range (° C.) | 213-376 | 195-366 | 190-361 | 190-363 |
| Density (20/4° C.) | 0.9477 | 0.8600 | 0.8607 | 0.8799 |
| Sulfur (mg/kg) | 6870 | 6 | 1 | 5 |
| Arom. SFC (% w/w) | 72 | 26 | 3 | 28 |
| No Cetane (ASTM D-613) | 12 | 40 | 40 | 35 |

| Operating Conditions | Units | Invention (*) | HDT 1st Est. NiMo + 2nd Est. PtPd (*) | HDT Severe NiMo |
|---|---|---|---|---|
| $H_2$ Partial Pressure | Kgf/cm$^2$ | 93/81 | 115/51 | 131 |
| WABT | ° C. | 343/390 | 370/280 | 377 |
| LHSV | $h^{-1}$ | 1.5/1.0 | 1.0/2.0 | 1 |
| Consumption of H2 | NL/L | 236/120 = 356 | 352/132 = 484 | 350 |

(*) First Stage/Second Stage

Example 4 is based on the information provided by Table 4, which presents some characterizations of products that can be obtained from the claimed process. This invention is the only one that claims a process that contributes to the flexibilization of production of refinery fuels, with a high density and aromaticity and with a high content of nitrogen compounds, which usually used in the production of low value-added products (fuel oil diluent or bunker) or added to the charge of units of HDT diesel oil.

TABLE 4

Properties of the PEV sections obtained from the effluent end of the LCO hydroconversion process.

| PRODUCTS | NAPHTHA | KEROSENE | TOTAL DIESEL | HEAVY DIESEL |
|---|---|---|---|---|
| Distillation Range | PIE-150° C. | 150-240° C. | 150° C.-PFE | 240° C.-PFE |
| Density@ 20/4° C. ASTM D-4052 | 0.7716 | 0.8470 | 0.8600 | 0.8679 |
| °API | 51.0 | 34.8 | 32.3 | 30.8 |
| Simulated Distillation ASTM D-86, ° C. | | | | |
| PIE/10% vol. | 73/104 | 174/191 | 195/217 | 261/262 |
| 30% vol./50% vol. | 111/118 | 199/206 | 234/252 | 270/278 |
| 70% vol./90% vol. | 127/141 | 213/222 | 275/318 | 298/335 |
| 95% vol./PFE | 148/171 | 226/235 | 340/366 | 355/377 |
| viscosity ASTM D-445 @ T1° C., cSt | — | 1.987 @ 20° C. | 3.905 @ 20° C. | 3.899 @ 40° C. |
| viscosity ASTM D-445 @ T2° C., cSt | — | 1.488 @ 37.8 | 2.681 @ 37.8° C. | 2.614 @ 60° C. |
| viscosity ASTM D-445 @ T3° C., cSt | — | 1.248 @ 50° C. | 2.132 @ 50° C. | 1.432 @ 100° C. |
| Sulfur Total ASTM D-5453, mg/kg | 27.7 | <1.0 | 6.2 | 6.9 |
| Total Nitrogen ASTM D-5762, mg/kg | 1.6 | <0.5 | 0.5 | 0.8 |
| Ramsbottom ASTM D-524 Carbon Residue (% w/w) | — | — | 0.09 | 0.06 |
| Cetane Number ASTM D-613 | — | — | 40 | 45 |
| Cetane Index ASTM D-4737 | — | 28 | 40 | 46 |
| Octane MON | 68 | — | — | — |
| Octane RON | 70 | — | — | — |
| Flash Point Closed Cup ASTM D-93, ° C. | — | 61 | 75 | 119 |
| Soot Dot ASTM D-1322-08, mm | — | 16.0 | — | — |
| Freezing point ASTM D-7153, ° C. | — | <−60 | — | — |
| Buffer Point ASTM D-6371-05, ° C. | — | <−51 | −10 | −3 |
| Lubrication, μm | — | 668 | 494 | 227 |
| Color ASTM | — | — | 4.0 | 5.0 |
| Color Saybolt | — | 27.0 | — | — |
| Corrosivity to Copper, 3 h/50° C. | — | 1a | 1a | 1a |
| Hydrocarbon Content - FIA PNA by Gas Chromatography | | | | |
| Aromatic, % w/w | 16.8 | — | — | — |
| Naphthenic Paraffins, % w/w | 56.0 | — | — | — |
| Standard Paraffins, % w/w | 9.0 | — | — | — |
| Branched Paraffins, % w/w | 16.8 | — | — | — |
| Hydrocarbons per FIA | | | | |
| Aromatic, % vol. | — | 20.7 | — | — |
| Olefin, % vol. | — | 1.0 | — | — |
| Saturated, % vol. | — | 78.0 | — | — |

As can be observed, in one of the modes of operation that includes the operation of the rectification tower 36 (FIG. 1) and the fractionator tower 39 (FIG. 2), different cuts can be produced:

The $C_5$-150° C. cut has low sulfur content (<30 mg/kg), low MON and RON (especially gasoline MON>82), consisting predominantly of naphthenic compounds. In this way, it is claimed that it is a gasoline pool that has an octane clearance in order to reduce the sulfur content thereof. Can also be used as unit charge of catalytic reforming containing hydrodesulfurization pretreatment. It can also be a charge of processes that increase the octane rating of naphthenic streams in the distillation range of naphtha, such as the opening of a naphthenic cycle followed by isomerization;

The 150-240° C. cut can make up a pool of aviation kerosene. This cut is suitable for the composition of aviation kerosene pool with predominance of highly hydrogenated charges, more preferably with predominance of charges from gas oil hydrocracking, guarantee the minimum content of aromatic compounds required by the ASTM D7566-11A; The 240° C.-PFE diesel cut and its composition with the 150-240° C. cut is an excellent leap in quality as compared to the characteristics of the charge, and can be added to the diesel oil pool, thus adding value to the LCO; The diesel oil pool can also be made up of naphtha ($C_5$-150° C.), kerosene (150-240° C.) and diesel (240° C.-PFE) or by mixing (150-240° C.) and (240° C.-PFE) diesel or the mixture of naphtha ($C_5$-150° C.) and (240° C.-PFE) diesel, among other possible options combinations.

By pool it is understood the composition of streams generated by the process as requested herein with the inclusion of other refinery streams from other existing processes or from the process of implementation in the refinery.

By naphtha is meant the cut in the typical distillation range of $C_5$ at 150° C., preferentially, which may alternatively present a final boiling in the range of about 120 to 140° C., for example. Kerosene is understood as a cut, preferentially in the distillation range from 150 to 240° C., which may alternatively present an initial boiling point between 120 and 140° C. and final boiling points between 230 and 260° C. Diesel means the cuts in the distillation range of 240° C. to a final boiling point from the second stage effluent, temperatures between 230 and 260° C. The diesel fraction can also correspond to the composition of the kerosene and diesel fractions, previously mentioned.

It should also be noted that the proceeding as total effluent that presents characteristics of the distillation range of diesel oil with yield of at least 111% vol. in relation to the process charge.

The description thus far made of the object of this invention should be considered only as one or more possible realizations, and any particular features introduced therein must be understood just as something that was written to make it easier to understand. In this way, may in any way be considered as limiting the invention, which is limited to the scope of the claims that follow.

The invention claimed is:

1. A process for refining highly (poly)aromatic and nitrogenated feedstock, comprising:

hydrotreating a (poly)aromatic and nitrogenated feedstock in a first stage reaction section to produce a first stage effluent;

separating in a separating section the first stage effluent into a gaseous stream and a liquid stream;

hydrocracking the liquid stream from the separating section to obtain a second stage effluent; and subjecting the second stage effluent to rectification and/or fractionation to obtain medium distillates, wherein the (poly)aromatic and nitrogenated feedstock comprises a total aromatic content from 20 to 90% w/w; a total (poly)aromatic content from 10 to 80% w/w; and a content of nitrogen compounds from 300 to 5000 mg/kg; and the first stage effluent comprises a content of nitrogen compounds from 100 to 500 mg/kg.

2. The process for refining highly (poly)aromatic and nitrogenated feedstock according to claim 1, characterized in that it allows the flexibilization of fuel production in a refinery through an exclusive operation of the rectification or through an operation of both the rectification and the fractionation.

3. The process for refining highly (poly)aromatic and nitrogenated feedstock according to claim 1, wherein the second stage effluent is subjected to the rectification, and the rectification is characterized by having a rectification column system that generates a gas charge and a liquid charge; the gas charge contains light hydrocarbons, hydrogen, $H_2S$ and $NH_3$; the liquid hydrocarbon stream can optionally be added to a diesel oil pool of refineries, with higher gains in cetane, reduction of density and elevation of the volumetric yield by at least 111% in relation to a process charge, thus minimizing yield losses by over-cracking the naphtha and contributing to optimization of a required hydrogen consumption.

4. The process for refining highly (poly)aromatic and nitrogenated feedstock according to claim 1, wherein the second stage effluent is subjected to both the rectification and the fractionation, and the rectification and the fractionation is characterized by generating gaseous streams in a rectification and fractionation column system and for having two or three different liquid hydrocarbon cut streams leaving the fractionation section afterwards, allowing flexibilization of refinery fuel production, with optimization of a required hydrogen consumption, as follows:

a. a cut called naphtha is used to compose a gasoline pool or refinery petrochemical naphtha, used as a charge of reforming units for producing reformate gasoline and may also be used as feed for processes that increase an octane rating of naphthenic chains in a range of distillation of the naphtha, as naphthenic cycle opening followed by isomerization;

b. a cut called kerosene can make up a pool of refinery aviation kerosene;

c. a diesel cut or its composition with the cut kerosene achieving an increase in quality as compared to characteristics of the (poly)aromatic and nitrogenated charge, which can optionally be added to a refinery diesel oil pool, thereby adding value to the LCO;

d. the refinery diesel oil pool can optionally be composed of naphtha, kerosene and diesel or by mixing kerosene and diesel or naphtha and diesel.

5. The process for refining highly (poly)aromatic and nitrogenated feedstock according to claim 1, characterized by the content of nitrogen compounds in the first stage effluent comprising from 100 to 400 mg/kg.

6. The process for refining highly (poly)aromatic and nitrogenated feedstock according to claim 1, characterized in that the (poly)aromatic and nitrogenated feedstock is constituted by a mixture of refinery streams containing a light recycle oil (LCO) from a fluid catalytic cracking unit.

7. The process for refining highly (poly)aromatic and nitrogenated feedstock according to claim 1, characterized in that the (poly)aromatic and nitrogenated feedstock comprises total aromatic contents of 30 to 80% w/w, total (poly)aromatic contents of 15 to 75% w/w, and nitrogen compounds from 300 to 4000 mg/kg.

8. The process for refining highly (poly)aromatic and nitrogenated feedstock of claim 1, characterized in that the (poly)aromatic and nitrogenated feedstock has a relative density of 20/4° C. of from 0.9 to 1.0, and a cetane number less than 18.

9. The process for refining highly (poly)aromatic and nitrogenated feedstock of claim 1, characterized in that the hydrotreating comprises one or a series of reactors with one or more hydrotreatment catalyst beds, which include materials consisting of hydrogenating phases in the oxidized form supported on an inert matrix and/or with some acid/basic activity and/or with additives promoting acidic functions.

10. The process for refining highly (poly)aromatic and nitrogenated feedstock of claim 1, characterized in that the hydrotreating is driven with a partial pressure of hydrogen from 1 to 200 bar; a temperature between 200 and 450° C. and a volumetric space velocity (LHSV) between 0.1 to 5 $h^{-1}$.

11. The process for refining highly (poly)aromatic and nitrogenated feedstock of claim 1, characterized in that the separating gases is conducted in a separating vessel, and the top gas stream comprises a hydrogen-rich gas charge, ammonia and hydrogen sulfide.

12. The process for refining highly (poly)aromatic and nitrogenated feedstock of claim 1, characterized in that hydrocracking is constituted by one or a series of reactors with one or more hydroconversion/hydrocracking catalysts, which include materials consisting of a hydrogenation phase in an oxidized form supported on inert matrix and/or with some acidic activity and/or with additives promoters of acid functions or of a specific nature.

13. The process for refining highly (poly)aromatic and nitrogenated feedstock of claim 1, characterized by the hydrocracking being with a hydrogen partial pressure of 1 to 200 bar; a temperature between 200 and 450° C. and a LHSV from 0.1 to 5 $h^{-1}$.

14. The process for refining highly (poly)aromatic and nitrogenated feedstock of claim 1, characterized in that one or more catalytic beds of the reaction sections are cooled by quenches of a recycle gas or a liquid effluent obtained in the process itself.

15. The process for refining highly (poly)aromatic and nitrogenated feedstock of claim 1, characterized in that the top gas stream is combined with the second stage effluent prior to subjecting the second stage effluent to the rectification and/or the fractionation.

16. The process for refining highly (poly)aromatic and nitrogenated feedstock of claim 1, characterized in that the (poly)aromatic and nitrogenated feedstock comprises total aromatic contents of 50 to 70% w/w; total (poly)aromatic contents from 20 to 70% w/w; and nitrogen compounds from 500 to 3000 mg/kg.

17. The process for refining highly (poly)aromatic and nitrogenated feedstock of claim 1, characterized in that the content of nitrogen compounds in the first stage effluent is from 100 to 400 mg/kg.

18. The process for refining highly (poly)aromatic and nitrogenated feedstock of claim 1, characterized in that the content of nitrogen compounds in the first stage effluent is from 100 to 300 mg/kg.

19. The process for refining highly (poly)aromatic and nitrogenated feedstock of claim 1, characterized in that the hydrocracking of the liquid stream is constituted by one or a series of reactors comprising a noble metal base catalyst selected from the group consisting of platinum, palladium, rhodium, and iridium or a blend of one or more thereof.

20. The process for refining highly (poly)aromatic and nitrogenated feedstock of claim 1, characterized in that the noble metal base catalyst is supported in an inert matrix and/or with some acidic activity.

* * * * *